United States Patent [19]

Zimmerman et al.

[11] Patent Number: 4,836,829

[45] Date of Patent: Jun. 6, 1989

[54] FUEL COMPOSITION AND PROCESS FOR MULTI-PORT FUEL INJECTION SYSTEMS (PNE-509)

[75] Inventors: Abraham A. Zimmerman, Warren, N.J.; Geoffrey A. Canton, Oxfordshire, United Kingdom; Joel R. Siegel, Short Hills; Joseph Vardi, Demarest, both of N.J.

[73] Assignee: Exxon Research and Engineering Company, Florham Park, N.J.

[21] Appl. No.: 120,419

[22] Filed: Nov. 13, 1987

Related U.S. Application Data

[63] Continuation-in-part of Ser. No. 858,603, May 1, 1986, abandoned, which is a continuation-in-part of Ser. No. 840,320, Mar. 14, 1986, abandoned.

[51] Int. Cl.[4] ..... C10L 1/18; C10L 1/22

[52] U.S. Cl. ..... 44/53; 44/62; 44/63; 44/70; 44/71; 44/72; 44/76; 44/77

[58] Field of Search ..... 44/72, 62, 77, 53

[56] References Cited

U.S. PATENT DOCUMENTS

| | | | |
|---|---|---|---|
| 2,929,696 | 3/1960 | Barusch et al. | 44/66 |
| 3,115,400 | 12/1963 | Marsh et al. | 44/72 |
| 3,387,953 | 6/1968 | Bouffard | 44/63 |
| 3,594,139 | 7/1971 | Bouffard | 44/72 |
| 3,707,362 | 12/1972 | Zimmerman et al. | 44/72 |
| 4,231,883 | 11/1980 | Malec | 252/33.4 |
| 4,256,002 | 10/1982 | Knepper et al. | 44/62 |
| 4,409,000 | 10/1983 | LeSuer | 44/70 |
| 4,440,625 | 4/1984 | Cjo et al. | 44/63 |

OTHER PUBLICATIONS

Benson et al., "The Effects of Fuel Composition and Additives on Multiport Fuel Injector Deposits", SAE Technical Paper Series, 1986.

*Primary Examiner*—William R. Dixon, Jr.
*Assistant Examiner*—E. McAvoy
*Attorney, Agent, or Firm*—Roy J. Ott

[57] ABSTRACT

Vehicle driveability problems associated with deposits formed in multiport fuel injectors are alleviated by delivering fuel comprising a particular amine containing various $C_6$ to $C_{24}$ alkyl, aryl, cycloaliphatic, heterocyclic, substituted alkyl or substituted aryl groups and $C_1$ to $C_{24}$ alkyl, aryl, substituted alkyl or aryl, cycloaliphatic or heterocyclic groups. Particular amines include bis(2-hydroxy ethyl) cocoamine, bis(2-hydroxy ethyl tallow amine, bis(2-hydroxy ethyl) stearylamine, dimethylcocoamine, dimethyl hydrogenated tallow amine, dimethylhexadecylamine and mixtures thereof. Fuels containing the amine are stabilized against emulsions by inclusion in the fuel of certain demulsifiers. In the preferred embodiment, the amine is in combination with an oxide derivative thereof.

35 Claims, No Drawings

FUEL COMPOSITION AND PROCESS FOR MULTI-PORT FUEL INJECTION SYSTEMS (PNE-509)

CROSS REFERENCE TO RELATED APPLICATION

This application is a continuation-in-part of U.S. patent application Ser. No. 858,603, filed May 1, 1986 now abandoned which is a continuation-in-part of U.S. patent application Ser. No. 840,320, filed Mar. 14, 1986, now abandoned.

BACKGROUND OF THE INVENTION

This invention is directed to an antifouling fuel composition and to a method for using same. More specifically, the present invention is directed at a fuel composition having particular applicability in minimizing and/or preventing injector fouling in gasoline engines equipped with electronically controlled multiport fuel injectors.

Over the past several years, improvements have been made in the performance of internal combustion engines. One of the most significant improvements which has been made has been the widespread use of fuel injection to improve the performance and fuel economy of internal combustion engines. While carburetor-equipped internal combustion engines admix the air and fuel for distribution through a manifold to all of the cylinders, in a fuel injected engine the fuel is injected into the manifold close to the intake valve of each cylinder for combustion. Fuel injection systems are of two basic types, mechanically controlled and electronically controlled. The early fuel injected engines were controlled mechanically, i.e., the operation of each injector was controlled by pressure. Recently, however, the use of electronically controlled fuel injection engines has become increasingly widespread. In an electronically controlled fuel injection system sensors disposed in the exhaust are employed to maintain the air to fuel ratio within narrow limits. Electronically controlled fuel injection systems offer the same performance and fuel economy benefits that would be achieved with mechanically controlled fuel injection systems and also serve to more closely regulate fuel-air mixtures to thereby enable the catalytic converter to oxidize carbon monoxide and hydrocarbons to carbon dioxide and simultaneously to reduce nitrogen oxides and thus meet emissions control legislation. Such legislation imposing as it did strict control of exhaust pollutants utimately led to the development and widespread application of new technologies such as electronic fuel injection.

It has been found that the electronically controlled fuel injector systems have small port openings which are prone to fouling by deposits. These deposits are believed to occur, at least in part, by gasoline and oil vapor, which is present in close proximity to the injector tip, becoming baked onto the hot surfaces of the injector pintle and on the surfaces of the annulus surrounding the pintle when the engine is shut off. These deposits restrict the fuel flow to that particular cylinder. This, in turn, causes a sensor disposed in the exhaust to detect a higher than desired oxygen to fuel ratio. The sensor will attempt to correct this condition by increasing the amount of fuel injected into all of the cylinders. This, in turn, will result in a richer than desired fuel to air ratio in the exhaust. The sensor then will attempt to correct this by decreasing the amount of fuel injected into each cylinder. This cyclical adjustment of the fuel to air ratio ranging between too lean a mixture and too rich a mixture can at times result in poor operating performance of the vehicle. In addition, close tolerances in this new type of injector and concurrently higher underhood temperature also tend to enhance deposit formation resulting in poor vehicle driveability and exceeding exhaust pollutant levels set by emissions control legislation.

It has been found that conventional gasoline detergents, which have proven effective in preventing and/or eliminating carburetor deposits are not particularly effective in removing and/or preventing deposit build-up that may occur in electronically controlled fuel injection systems. For example, SAE Technical Paper Series 861533 entitled, The Effects of Fuel Composition and Additives on Multiport Fuel Injector Deposits (1986) discloses that very serious driveability problems have developed with vehicles equipped with multiport fuel injection systems. These problems are caused by deposits that formed in the metering orifice at the tip of the injector and restricted fuel flow. The study showed that all major gasoline brands were involved, including those gasolines which were thought to have good detergent additives. Several additives, representing specific examples of different additive chemistries, were tested in the base fuel. Some additives did alleviate injector fouling, others were not particularly effective, or did not work at all. Alkyl succinimide and polybutene succinimide appeared to be effective, polyether amine was ineffective in that failure occurred after about 4,000 miles of test run, whereas phenylene diamine was even less effective.

Presently available methods for removing deposits from fuel injector orifices typically comprise either mechanically cleaning the injectors or the addition to the fuel of relatively large quantities of particular additives. Mechanical cleaning, which may involve either the complete removal of the injector for manual deposit removal or the use of polar solvents for flushing the deposits free, is not desired because of the relatively high cost and inconvenience.

To be useful commercially a gasoline additive for reducing and/or preventing port fuel injector fouling must be effective at low concentration, must not significantly affect the combustion characteristics of the fuel and must not foul the catalytic converter catalyst.

Additives have been added to gasoline to improve certain properties of the fuel. U.S. Pat. No. 3,115,400 discloses the use of compounds of the structure

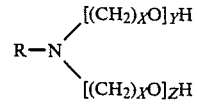

where R is a $C_6$–$C_{22}$ aliphatic hydrocarbon radical, X is an integer from 2 to 4, Y is an integer of at least 1, and Z is an integer of at least 1, for use in motor fuel to prevent or reduce carburetor icing.

U.S. Pat. No. 4,409,000 discloses combination of hydroxy amines and hydrocarbon-soluble carboxylic dispersants as engine and carburetor detergents for normally liquid fuels. Among the hydroxy amines disclosed are compounds of the formula

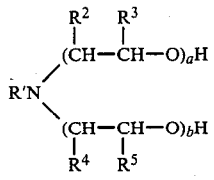

where R' may be an alkyl radical containing from about 8 to about 30 carbon atoms, where $R^2$, $R^3$, $R^4$ and $R^5$ each may be hydrogen and where a and b may be integers from 1 to 75.

U.S. Pat. No. 4,231,883 discloses the use of a compound of the formula

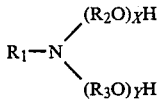

where $R_1$ is a $C_{12}$–$C_{36}$ aliphatic hydrocarbon group, $R_2$ and $R_3$ are divalent hydrocarbon radicals containing 2–4 carbon atoms and X and Y are integers from 1–4, for friction reduction in lube oils. Preferred compounds comprise N,N-bis (2-hydroxyethyl) hydrocarbylamines.

U.S. Pat. No. 3,387,953 is directed at the use of organo-substituted nitrogen oxides, particularly amine oxides for rust inhibition and as anti-icing agents in gasoline. Several representative formulas for amine oxides are given including the following:

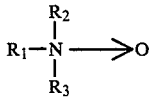

where: $R_1$ is $C_6$–$C_{24}$ alkyl, aryl, cycloaliphatic, heterocyclic, substituted alkyl or substituted aryl; and $R_2$ and $R_3$ are the same or different and are $C_1$–$C_{24}$ alkyl, aryl, substituted alkyl or aryl, cycloaliphatic or heterocylic. $R_2$ and $R_3$ preferably comprise hydroxy substituted alkyls. These compounds typically are added to gasoline in a concentration within the range of about 2.0 to about 100 pounds of amine oxide per 1,000 barrels of gasoline (ptb). Among the most preferred additives is bis(2-hydroxy ethyl) cocoamine oxide.

U.S. Pat. No. 3,594,139 is directed at a rust-inhibitor concentrate that can be blended with gasoline year-round. This patent also discloses the use of amine oxides having the aforementioned formula for use as gasoline additives for rust prevention. This patent also discloses a particularly preferred concentrate comprising bis(2-hydroxy ethyl) cocoamine oxide.

The amine oxides described above have been typically used to inhibit rust and carburetor icing, although these amines also were known as carburetor detergents.

It has been discovered that use of hydroxy substituted amine oxides can result in additive losses because of high water solubility and adsorption on polar surfaces.

Accordingly, it would be desirable to provide an additive package for gasoline which will be effective in reducing and/or eliminating fouling without appreciable additive losses.

It also would be desirable to provide an additive package having a demulsifying agent which is effective in the presence of both neutral and basic waters.

Accordingly, it would be desirable to provide a gasoline additive package which is relatively inexpensive and effective at low concentrations to reduce and/or eliminate injector fouling.

It also would be desirable to provide a gasoline additive package which is non-corrosive, non-deleterious to the catalyst, and does not affect the combustion characteristics of the fuel.

It also would be desirable to provide a gasoline additive package which could be easily added to the finished gasoline at any point during the storage and/or distribution system.

SUMMARY OF THE INVENTION

The present invention is directed at a fuel composition for minimizing and/or preventing injector fouling in a multiport electronically controlled fuel injected engine. The composition comprises:

A. gasoline

B. an anti-fouling agent having the formula:

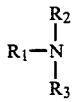

where: $R_1$ is $C_6$–$C_{24}$ alkyl, aryl, cycloaliphatic, heterocyclic, substituted alkyl or substituted aryl; and $R_2$ and $R_3$ independently are $C_1$–$C_{24}$ substituted alkyl, aryl, cycloaliphatic or heterocylic; and, C. a demulsifying agent selected from the group consisting of:

i. acylated polyglycols;

ii. alkyl aryl sulfonates, polyglycols, oxyalkylated alkylphenol-formaldehyde resins;

iii. oxyalkylated alkylphenol-formaldehyde resins and polyglycols;

iv. oxyalkylated alkylphenol-formaldehyde resins;

v. fatty acid alkylamine reaction product; and vi. mixtures thereof.

In this composition $R_1$ preferably is $C_6$–$C_{20}$ alkyl, or alkylated aryl, and $R_2$ and $R_3$ independently are $C_1$–$C_{12}$ hydroxy substituted alkyl. In a more preferred composition $R_1$, comprises $C_8$–$C_{18}$ substituents derived from fatty acid. The additive preferably is selected from the group consisting of bis(2-hydroxy ethyl) cocoamine, bis(2-hydroxy ethyl) tallow amine, bis(2-hydroxy ethyl) stearyl-amine, bis(2-hydroxy ethyl) oleyl amine and mixtures thereof. A particularly preferred additive is bis(2-hydroxy ethyl) cocoamine. The anti-fouling agent concentration in the fuel typically may range between about 2 to about 200 ppm, (parts per million by weight based on the total weight of the fuel composition) preferably between about 40 to about 120 ppm. The active concentration of the demulsifying agent may range between about 0.1 and about 20 ppm, preferably between about 1.0 and about 8 ppm. A preferred demulsifier is selected from the group consisting of:

i. acylated polyglycols;

ii. alkyl phenol-formaldehyde resins and polyglycols;

iii. oxyalkylated alkylphenol-formaldehyde resin; and iv. mixtures thereof.

A fuel composition such as gasoline, typically may further comprise:

A. about 2 to about 200 ppm bis(2-hydroxy ethyl) cocoamine; and,

B. about 0.1 to about 20 ppm of a demulsifying agent selected from the group consisting of:

i. acylated polyglycols;

ii. alkyl aryl sulfonates, polyglycols, oxyalkylated alkylphenol-formaldehyde resins;

iii. oxyalkylated alkylphenol-formaldehyde resins and polyglycols;

iv. oxyalkylated alkylphenol-formaldehyde resins;

v. fatty acid alkylamine reaction product; and vi. and mixtures thereof.

In a preferred embodiment of the invention, the fuel additive also includes about 2 to about 200 ppm of a second anti-fouling agent having the following structural formula:

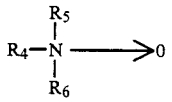

where $R_4$ is $C_6$–$C_{24}$ alkyl, aryl, cycloaliphatic, heterocyclic, substituted alkyl, substituted aryl; $R_5$ and $R_6$ independently are $C_1$–$C_{24}$ alkyl, aryl, substituted alkyl or aryl, cycloaliphatic, heterocyclic, and mixtures thereof.

Preferred amine oxide anti-fouling agents include compounds wherein: $R_4$ is $C_6$–$C_{20}$ alkyl, or alkylated aryl; and $R_5$ and $R_6$ independently are hydroxy substituted $C_1$–$C_{12}$ alkyl. Particularly preferred compounds are compounds wherein $R_1$ comprises a $C_8$–$C_{18}$ substituent. The amine oxide additive preferably is selected from the group consisting of bis (2-hydroxy ethyl) cocoamine oxide, bis(2-hydroxy ethyl) stearylamine oxide, dimethylcocoamine oxide dimethyl hydrogenated tallow amine oxide, dimethylhexadecylamine oxide, and mixtures thereof. A particularly preferred amine oxide anti-fouling agent is bis(2-hydroxy ethyl) cocoamine oxide.

It has been unexpectedly found that the combination of the aforedescribed amines and amine oxides of the invention exhibits less additive loss, particularly at low temperatures, than the amine oxide without the presence of the amine. Additive loss results from water solubility and adsorption on polar surfaces. The amine appears to function as a solvent for the amine oxide, as well as an antifouling agent for multi-port fuel injection systems.

A particularly preferred fuel composition comprises:

A. about 20 to about 120 ppm bis(2-hydroxy ethyl) cocoamine; and,

B. about 4 to about 40 ppm bis(2-hydroxy ethyl) cocoamine oxide; and

C. about 1 to about 12 ppm of a demulsifying agent selected from the group consisting of:

i. acylated polyglycols;

ii. alkyl aryl sulfonates, polyglycols, oxyalkylated alkylphenol-formaldehyde resins;

iii. oxyalkylated alkylphenol-formaldehyde resins and polyglycols;

iv. oxyalkylated alkylphenol-formaldehyde resins;

v. fatty acid alkylamine reaction product; and vi. and mixtures thereof.

A preferred fuel additive concentrate for internal combustion engines comprises:

A. about 5 to about 60 wt. % bis(2-hydroxy ethyl) cocoamine;

B. about 1 to about 20 wt. % bis (2-hydroxy ethyl) cocoamine oxide;

C. about 0.25 to about 10 wt. % of a demulsifying agent selected from the group consisting of:

i. acylated polyglycols;

ii. alkyl aryl sulfonates, polyglycols, oxyalkylated alkylphenol-formaldehyde resins;

iii. oxyalkylated alkylphenol-formaldehyde resins and polyglycols;

iv. oxyalkylated alkylphenol-formaldehyde v. fatty acid alkylamine reaction product; and mixtures thereof;

D. about 40 to about 95 wt. % solvent.

The solvent preferably comprises an alkyl aromatic hydrocarbon solvent, such as xylene, and a $C_4$+alcohol, preferably a $C_4$–$C_{12}$ alcohol, more preferably a $C_8$ alcohol and most preferably a $C_8$ oxo alcohol. Where the ratio of the concentration of water relative to amine oxide exceeds about 0.05, a highly water and hydrocarbon soluble alcohol, preferably isopropanol, also should be added.

The present invention also is directed at a method for reducing and/or preventing fouling in an electronically controlled fuel injection system for an internal combustion engine, said method comprising delivering to said fuel injection system a fuel comprised of an effective amount of the aforedescribed amine anti-fouling agent of the invention.

In a preferred embodiment, the invention is directed at a method for reducing and/or preventing fouling in an electronically controlled fuel injection system for an internal combustion engine by delivering to said fuel injection system a fuel comprised of an effective amount of an anti-fouling agent comprising both the aforedescribed amine and the amine oxide of the invention.

DETAILED DESCRIPTION OF THE INVENTION

The present invention is directed at a fuel composition, a gasoline additive package, and a method for delivering the fuel composition to a fuel injection system in which the composition has been found to be particularly effective in reducing and/or eliminating injector fouling. The present invention is directed at a fuel comprising:

A. gasoline;

B. an anti-fouling agent having the following structural formula:

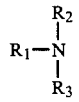

where $R_1$ is $C_6$–$C_{24}$ alkyl, aryl, cycloaliphatic, heterocyclic, substituted alkyl, substituted aryl; $R_2$ and $R_3$ independently are $C_1$–$C_{24}$ substituted alkyl or aryl, cycloaliphatic, heterocyclic, and mixtures thereof; and, C. a demulsifying agent selected from the group consisting of:

i. acylated polyglycols;

ii. alkyl aryl sulfonates, polyglycols, oxyalkylated alkylphenol-formaldehyde resins;

iii. oxyalkylated alkylphenol-formaldehyde resins and polyglycols; and, iv. oxyalkylated alkylphenol-formaldehyde resins;

v. fatty acid alkylamine reaction product; and mixtures thereof.

Preferred anti-fouling agents include compounds wherein: $R_1$ is $C_6$–$C_{20}$ alkyl, or alkylated aryl; and $R_2$ and $R_3$ independently are hydroxy substituted $C_1$–$C_{12}$ alkyl. Particularly preferred compounds are compounds wherein $R_1$ comprises a $C_8$–$C_{18}$ substituent. The additive preferably is selected from the group consisting of bis (2-hydroxy ethyl) cocoamine, bis(2-hydroxy ethyl) stearylamine, bis(2-hydroxy ethyl) oleyl amine and mixtures thereof. These additives are prepared in accordance with known techniques, such as disclosed in U.S. Pat. No. 2,541,678 the disclosure of which is incorporated herein by reference. A particularly preferred anti-fouling agent is bis(2-hydroxy ethyl) cocoamine.

Amine oxides also have been found to be effective as anti-fouling agents. While these compounds may be extracted to varying degrees into any water present, these compounds also provide anti-rust properties to the fuels. These compounds have the following structural formula:

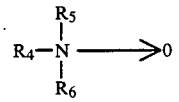

where $R_4$ is $C_6$–$C_{24}$ alkyl, aryl, cycloaliphatic, heterocyclic, substituted alkyl, substituted aryl; $R_5$ and $R_6$ independently are $C_1$–$C_{24}$ alkyl, aryl, substituted alkyl or aryl, cycloaliphatic, heterocyclic and mixtures thereof.

Therefore, the use of these amine oxides compounds in combination with the previously described amines may provide an effective anti-fouling composition also providing anti-rust properties. These amine oxides may be prepared by well-known techniques, such as disclosed in U.S. Pat. No. 3,387,953.

Where amine and amine oxides are used in combination as the anti-fouling agent, the concentration of the amine typically will range between about 2 and about 200 ppm, preferably between about 40 and about 120 ppm, while the amine oxide concentration will range between about 2 and about 80 ppm, preferably between about 4 and about 40 ppm.

The amine oxide typically has water present from the manufacturing process. While it is possible to remove most of the water, removal of the water to relatively low levels, i.e. a ratio of about 0.02 to about 0.04 of water to amine oxide, adds complexity to the manufacturing process. Therefore, the amine oxide is commercially available as a solution comprising water and a solvent, which typically is isopropyl alcohol. It has been found that when a concentrate comprising the above amine oxide solution and a solvent containing demulsifiers was admixed with gasoline and terminal tank water bottoms a three phase system resulted, two organic phases and a water phase.

Formation of two organic layers is not desirable, since this was found to result in uneven distribution of the amine oxide between layers. In addition, the second organic layer, which has a much higher amine oxide concentration, tends to adhere to surfaces, resulting in additive loss and potential contamination of subsequent hydrocarbon products that might contact these surfaces. It has been found that replacement of a portion of the isopropanol by a higher alcohol, preferably a $C_4$–$C_{12}$ alcohol, more preferably a $C_8$ oxo alcohol, decreases the likelihood of forming a two organic layer system. While the admixture of the amine with the amine oxide may also decrease the formation of two organic phases, it is preferred that the solvent comprise a $C_4$–$C_{12}$ alcohol as described above to further decrease the possibility of two organic phase formation.

A concentrate utilizing both the amine and amine oxide typically also comprises about 40 to about 95 wt. % solvent. A preferred composition range is as follows:

| Component | Wt. % Range |
|---|---|
| Amine | 8–32 |
| Amine Oxide | 2–8 |
| Solvent | |
| Xylene | 30–80 |
| $C_4$–$C_{12}$ alcohol | 2–20 |
| Isopropanol | 2–16 |
| Water | 0.2–1.5 |
| Demulsifier | 1–4 |

Where the presently described invention is used as a gasoline additive, the additive package may be added to the gasoline at any point after the gasoline has been refined, i.e., the additive package can be added at the refinery or in the distribution system.

The following Comparative Examples and Examples demonstrate the utility of the anti-fouling agent in reducing and/or eliminating fuel injector fouling. In the following Comparative Examples and Examples, the octane rating of the fuel utilized is the posted octane rating which is defined as:

$$\frac{\text{Research Octane} + \text{Motor Octane}}{2}$$

COMPARATIVE EXAMPLE I

In this test three 1985 Oldsmobile 98's having electronically controlled, fuel injected, 3.8 liter, six cylinder engines were driven on a commercial, unleaded, 87 octane reference fuel having a detergent concentration of about 32 ppm by weight of the fuel. The detergent, which is a multipurpose additive, in this gasoline was an aliphatic tertiary amine having one long straight chain of from 12 to 20 carbon atoms and two short chain alkyl groups of from 1 to 3 carbon atoms.

The vehicles were driven for approximately 3500 miles under the following driving cycle: 0.5 hours city-type driving, 0.5 hour engine off, 0.5 hour highway driving, 0.5 hour engine off. Driveability on all four vehicles became poor to very poor. The vehicles then were driven for 300 miles with a commercial premium grade 92 octane unleaded fuel containing 2.5 times the detergent used in the above reference fuel. Driveability remained unchanged. The data in Table I below show that there was still a marked reduction in fuel flow indicating that a high level of deposit was unaffected by the detergent even at the high treat rate. The percent fuel flow reduction was determined by measuring the volume of a mineral spirit that flowed through the injector under predetermined standardized conditions, including fuel pressure, pulse width and duty cycle. The percent reduction is calculated using the formula:

$$\% \text{ Reduction} = \frac{V_{clean} - V_{dirty}}{V_{clean}} \times 100\%$$

where $V_{clean}$ and $V_{dirty}$ are the measured volumes of mineral spirit passed through the clean and dirty fuel injectors.

TABLE I

| % FLOW REDUCTION THROUGH INJECTOR PORTS | | | | | | |
|---|---|---|---|---|---|---|
| Cyl # | 1 | 2 | 3 | 4 | 5 | 6 |
| Car A | 11 | 12 | 35 | 30 | 7 | 10 |
| Car B | 7 | 9 | 12 | 38 | 9 | 14 |
| Car C | 22 | 11 | 28 | 4 | 11 | 10 |
| Typical New Injectors | 2 | 2 | 0 | 0 | 2 | 1 |

From Table I it can be seen that this conventional, known carburetor detergent was ineffective in removing deposits from injector ports and in fact permitted deposits to form.

COMPARATIVE EXAMPLE II

A 1985 Chrysler LeBaron equipped with a 2.2 liter turbocharged engine having electronically controlled fuel injection was driven for 2858 miles on a mileage accumulation dynamometer using a typical regular grade, 87 octane, unleaded, detergent-free gasoline. The driving was based on repetition of the following cycle: 30 minutes city driving, 30 minutes engine off, 30 minutes highway driving, 30 minutes engine off. The driveability became very poor as typified by rough idle, severe hesitation, backfire and roughness during acceleration. The hydrocarbon emissions measured before the catalytic converter were 804 ppm at engine idle and 725 ppm at 2500 rpm. The injector fouling also was measured using a pressure differential test. In this test the fuel rail is pressurized to 49 psig and an injector is pulsed for 0.5 seconds. The difference in the pressure drop between the injectors is a rough measure of the degree to which the injectors are obstructed, i.e. the greater the numerical difference between the highest and lowest values, the greater the injector fouling. A summary of the results at 2585 miles on the detergent-free fuel are set forth in Table II as the measurements at 0 miles after HECA addition.

EXAMPLE I

Following the test set forth in Comparative Example II, the vehicle was refueled with the same fuel except that the fuel also contained 80 ppm of bis(2-hydroxy ethyl) cocoamine (HECA). The vehicle then was driven on the following cycle: 15 minutes city driving, 30 minutes highway driving, 15 minutes city driving, 2 hours engine off. This test continued until 308 miles were accumulated on the vehicle. At the end of this test period the driveability was very good. The hydrocarbon emissions at idle before the catalytic converter were reduced to 65 ppm and to 16 ppm at 2500 rpm. The emissions before the catalytic converter at idle and at 2500, rpm and the pressure differentials measured at various intervals during the clean-up driving are summarized in Table II. The injector flow reduction measurements are summarized in Table III.

From the data of Example I and Tables II and III, it can be seen that the use of a relatively low concentration of HECA was able to produce a significant improvement in driveability. The idle emissions were significantly reduced and the pressure differential and percent flow reduction of the flow injectors were returned to "as new" conditions after a relatively few miles of driving.

TABLE II

| MILES AFTER ADDITION OF HECA | EMISSIONS BEFORE CATALYTIC CONVERTER | | | | P LEAKDOWN, PSI | | | |
|---|---|---|---|---|---|---|---|---|
| | IDLE | | 2500 RPM | | CYL # | | | |
| | HC, PPM | CO % | HC, PPM | CO % | 1 | 2 | 3 | 4 |
| 0 | 804 | 0.68 | 725 | 0.31 | 17 | 18 | 20 | 21 |
| 73 | 813 | 1.78 | 188 | 1.99 | 17 | 17 | 19 | 22 |
| 140 | 375 | 0.95 | 35 | 1.10 | 17.5 | 18.5 | 19 | 20.5 |
| 219 | 95 | 0.70 | 30 | 0.75 | 19 | 19 | 19.5 | 25 |
| 308 | 65 | 0.67 | 16 | 0.69 | 23 | 24 | 24 | 25 |

TABLE III

| MILES DRIVEN AFTER HECA ADDITION | PORT INJECTOR FLOW REDUCTION | | | | |
|---|---|---|---|---|---|
| | INJECTOR NO. | 1 | 2 | 3 | 4 |
| 308 | % FLOW REDUCTION | 0 | 0 | 0 | 1 |

COMPARATIVE EXAMPLE III

A second 1985 Chrysler LeBaron equipped with a 2.2 liter turbocharged engine was driven on a mileage accumulation dynamometer using a regular grade 87 octane unleaded, detergent-free gasoline from a different batch from that of Comparative Example II and Example I. The same driving cycle was used in this Comparative Example as was used in Comparative Example I. The engine was judged to be fouled and the driveability poor after 4016 miles.

The emissions before the catalytic converter and the pressure differential across each injector were measured and are presented in Table IV as the measurements at 0 miles after HECA addition.

EXAMPLE II

Approximately 60 ppm of bis(2-hydroxy ethyl) cocoamine was added to the fuel of Comparative Example III and the vehicle of Comparative Example III was driven on the same driving cycle described in Example I. Measurements of the emissions before the catalytic converter and the pressure differential across each injector were measured as previously described. These reslts are presented in Table IV. Driveability was judged to be good after only 357 miles of driving. At the termination of the test the injectors were removed and flow tested as previously described. These results are presented in Table V.

TABLE IV

| MILES AFTER ADDITION OF HECA | EMISSIONS BEFORE CATALYTIC CONVERTER | | | | P LEAKDOWN, PSI | | | |
|---|---|---|---|---|---|---|---|---|
| | IDLE | | 2500 RPM | | CYL # | | | |
| | HC, PPM | CO % | HC, PPM | CO % | 1 | 2 | 3 | 4 |
| 0 | 148 | 2.17 | 126 | 2.21 | 11.0 | 10.0 | 12.5 | 10.0 |
| 188 | 190 | 2.6 | 125 | 3.2 | 15.0 | 16.0 | 19.0 | 21.0 |
| 359 | 112 | 0.94 | 53 | 1.12 | 15.5 | 16.0 | 16.0 | 16.5 |

TABLE V

| PORT INJECTOR FLOW REDUCTION | | | | | |
|---|---|---|---|---|---|
| MILES DRIVEN AFTER HECA ADDITION | INJECTOR NO. | 1 | 2 | 3 | 4 |
| 359 | % FLOW REDUCTION | 5 | 2 | 1 | 0 |

From a review of Tables II–V it can be seen that the use of relatively low concentrations of HECA was able to reduce the injector tip deposits in a relatively short period of time. By comparison, the use of a conventional carburetor detergent was unable to prevent a relatively rapid deposit buildup of injector tip deposits.

While the data presented above has demonstrated the utility of the anti-fouling agent in gasoline, the anti-fouling agent also may be of utility in other fuels, such as diesel fuel.

While the presently described anti-fouling agent may be used alone, it also may be desirable to utilize the present invention in combination with a demulsifying agent to facilitate the separation of the gasoline from any foreign substances which may be present in the distribution system, such as water and sediment.

The water, if any, typically has a pH ranging from about 7 to about 13. Thus, a demulsifying agent for use with the anti-fouling agent preferably should be effective over this pH range. The following Comparative Examples and Examples demonstrate the utility of various demulsifying agents.

COMPARATIVE EXAMPLE IV

In this Comparative Example the effectiveness of various commercially available demulsifying agents were tested in a 90 wt. % fuel - 10 wt. % water system. The fuel contained an additive package comprising approximately 60 ppm HECA and 2 ppm of the various additives noted below. The effectiveness of the various demulsifying agents was determined using a modified Multiple Contact Emulsion Test. In this test 10 ml of terminal water bottoms having a pH of approximately 10 was added to separate half-pint bottles. To each bottle was added 100 ml of gasoline. The bottles were capped, placed on their sides in a mechanical shaker and agitated at approximately 180 cycles per minute for ten minutes. The bottles then were placed upright and allowed to stand for 1 hour. The mixture then was rated considering the gasoline layer, the water layer and the interface using the rating scale set forth in Table VI below. After the ratings were completed, the gasoline level was sucked down to a level about ¼ inch above the interface or emulsion layer without disturbing the interface or water layer. The withdrawn fuel was discarded and 100 ml of fresh gasoline was added to each bottle. The mixture was then shaken and the test repeated for the indicated number of times with the worst rating noted. The trade names of the commercially available additives utilized, the worst ratings of each mixture and the number of times the test was run are set forth in Table VII below. The description of the demulsifiers listed in Table VII is given in Table VIII.

TABLE VI

| RATING SCALE FOR REPORTING EMULSION TEST RESULTS | |
|---|---|
| RATING | DESCRIPTION OF EMULSION |
| 0 | No skin or interface |
| 1 | Slight skin on interface - not completely continuous |
| 2 | Thicker skin on interface - usually completely continous |
| 3 | Incipient emulsion ⅛ as thick as water layer |
| 4 | Emulsion ¼ as thick as water layer |
| 5 | Emulsion ⅜ as thick as water layer |
| 6 | Emulsion ½ as thick as water layer |
| 7 | Emulsion ⅝ as thick as water layer |
| 8 | Emulsion ¾ as thick as water layer |
| 9 | Emulsion ⅞ as thick as water layer |
| 10 | Emulsion completely filling water layer Emulsion of maximum severity |

TABLE VII

| EMULSION TEST RESULTS | | |
|---|---|---|
| DEMULSIFIER DESCRIPTION | WORST RATING | NO. OF TIMES TEST RUN |
| Tolad T-292 | 3 | 2 |
| Tolad T-347 | 3 | 2 |
| Tolad T-370 | 4 | 1 |
| Nalco 5450 | 4 | 1 |
| Nalco 5451 | 3 | 4 |
| Nalco 5452 | 3–4 | 4 |
| Nalco 5453 | 4 | 1 |
| Nalco 85BD-194 | 4 | 1 |
| Nalco 3BD-829 | 4 | 1 |

TABLE VIII

| DESCRIPTION OF DEMULSIFIERS LISTED IN TABLE VII | |
|---|---|
| Demulsifier | Description |
| Tolad T-292 | Oxyalkylated alkylphenol formaldehyde resins in aromatic hydrocarbons and isopropanol |
| Tolad T-347 | Oxyalkylated alkylphenol formaldehyde resins and acylated polyglycols in aromatic hydrocarbons and methanol |
| Tolad T-370 | Polyglycols in aromatic hydrocarbons |
| Nalco 5450 | Hydrocarbon blend of alkylphenol formaldehyde resin polyoxyalkylene polyether |
| Nalco 5451 | Polyglycolated polyol esters and polyglycolated alkylphenol/formaldehyde resin in aromatic solvent |
| Nalco 5452 | Polyolpolyethers and oxyalkylated alkylphenol/formaldehyde resin adducts in aromatic solvent |
| Nalco 5453 | Oxyalkylated alkylphenol/formaldehyde resin adducts in aromatic solvent |
| Nalco 85BD-194 | Ethoxylated nonyl phenol/formaldehyde resin in hydrocarbon solvent |

EXAMPLE III

A 100 ml gasoline sample containing 60 ppm of HECA was admixed with 10 ml of the terminal water bottoms of Comparative Example IV. However, in place of the demulsifiers listed in Table VII the following demulsifiers were utilized individually: Tolad T-500; Tolad T-284; Tolad T-286; Tolad T-326; and Nalco 5455. The modified Multiple Contact Emulsion Test previously described was utilized to determine the effectiveness of each demulsifier. These test results are summarized in Table IX below. A description of each additive is presented in Table IX below.

TABLE IX

| EMULSION TEST RESULTS | | |
|---|---|---|
| DEMULSIFIER DESCRIPTION | WORST RATING | NO. OF TIMES TEST RUN |
| Tolad T-284 | 2 | 4 |
| Tolad T-286 | 1-2 | 4 |
| Tolad T-326 | 2 | 2 |
| Tolad T-500 | 2 | 4 |
| Nalco 5455 | 2 | 4 |

TABLE X

| DEMULSIFIER DESCRIPTIONS | |
|---|---|
| Demulsifier | Description |
| Tolad T-284* | Solution of acylated polyglycols in aromatic hydrocarbons |
| Tolad T-286* | Alkyl aryl sulfonates, polyglycols, oxyalkylated alkylphenol-formaldehyde resins in aromatic hydrocarbons and isopropyl alcohol |
| Tolad T-326* | Oxyalkylated alkylphenol-formaldehyde resins and polyglycols in aromatic naphtha |
| Tolad T-500* | Oxyalkylated alkylphenol-formaldehyde resins in aromatic hydrocarbons and alkanols |
| Nalco 5455** | Oxyalkylated alkyl phenol-formaldehyde resin in aromatic solvent |

*Manufactured by Tretolite Division of Petrolite Corporation, St. Louis, Missouri.
**Manufactured by Nalco Chemical Company, Oak Brook, Illinois.

COMPARATIVE EXAMPLE V

A 1985 Chrysler LeBaron equipped with a 2.2 liter turbocharged engine was driven on a mileage accumulation dynamometer using a regular grade 87 octane unleaded detergent-free fuel. The driving cycle to foul the injectors was 30 minutes city-type driving, 30 minutes soak, 30 minutes highway driving, 30 minutes soak. The engine was judged to be fouled after 2,300 miles.

The emissions before the catalytic converter and the pressure differential across each injector were measured and are presented in Table XI as the measurement at 0 miles after additive addition.

EXAMPLE IV

This Example demonstrates the utility of using an additive comprising the combination of an amine and an amine oxide in cleaning up fouled injectors in the vehicle of Comparative Example V. The fuel utilized was similar to that of Comparative Example V, but further comprised 80 ppm of bis(2-hydroxy ethyl) cocoamine and 10 ppm of bis(2-hydroxy ethyl) cocoamine oxide. The driving cycle was the same as that of Example I. After 301 miles of driving the driveability went from very poor to good.

The measurements of the emissions before the catalytic converter and the pressure differential across each injector also were measured as previously described. These results also are presented in Table XI. At the termination of the test the injectors were removed and flow tested as previously described. These results are presented in Table XII.

Based on these results, it can be seen that the use of an additive comprising the amine and amine oxide in combination cleaned fouled injectors. Additional tests were run on other test vehicles. In almost all cases it has been found that this combination of amine and amine oxide cleaned fouled injectors in a relatively short period.

TABLE XI

| MILES AFTER ADDITIVE ADDITION | EMISSIONS BEFORE CATALYTIC CONVERTER | | | | P LEAKDOWN, PSI | | | | |
|---|---|---|---|---|---|---|---|---|---|
| | IDLE | | 2500 RPM | | CYL # | | | | MAX P |
| | HC, PPM | CO % | HC, PPM | CO % | 1 | 2 | 3 | 4 | DIFFERENCE |
| 0 | 491 | 1.66 | 175 | 1.32 | 14 | 16 | 21 | 19 | 5 |
| 151 | 1,112 | 2.22 | 140 | 2.43 | 17 | 19 | 19 | 24 | 7 |
| 301 | 128 | 0.77 | 61 | 1.06 | 18 | 19 | 18 | 19 | 1 |

TABLE XII

| PORT INJECTOR FLOW REDUCTION | | | | | |
|---|---|---|---|---|---|
| MILES AFTER ADDITIVE ADDITION | INJECTOR NO. | 1 | 2 | 3 | 4 |
| 301 | % FLOW REDUCTION | 2 | 1 | 4 | 2 |

EXAMPLE V

This Example illustrates the effectiveness of an amine antifouling agent of the invention to inhibit cold temperature loss of an amine oxide antifouling agent of the invention from gasoline.

In this Example, a measured amount of bis(2-hydroxy ethyl) cocoamine oxide was blended with an unleaded gasoline and exposed to a temperature of 25° F. for 24 hours. The concentration of the amine oxide additive remaining in the gasoline was then measured to determine additive settling loss. The test was then repeated except that bis(2-hydroxy ethyl) cocoamine was added to the amine oxide to determine its effect on settling loss exhibited by the amine oxide. The results given in Table XIII show that the addition of bis(2-hydroxy ethyl) cocoamine to the amine oxide substantially improved additive solubility at low temperatures. Moreover, the amount of water present in the gasoline remained virtually unchanged for the amine/amine oxide combination, indicating very little water/additive drop out. It was also observed that no settling loss of the amine occurred after 24 hours at 25° F.

TABLE XIII

| Additive | 24 Hour Settling Test at 25° F. Amine Oxide[1] in Gasoline, PTB[2] Initially | After 24 hours | Loss, % | Water in Gasoline, PPM Initially | After 24 hours |
|---|---|---|---|---|---|
| Amine oxide[1] | 5.5 | 3.6 | 34.5 | 108 | 56 |
| Amine Oxide[1] Amine[3] Combination | 5.0 | 4.8 | 4.0 | 117 | 114 |

[1] Bis(2-hydroxy ethyl) cocoamine oxide
[2] Pounds of additive per 1000 barrels of gasoline
[3] Combination contains 25 PTB of Bis(2-hydroxy ethyl) cocoamine

Comparative Example VI

A 1985 Chrysler LeBaron equipped with a 2.2 liter turbocharged engine was driven on a mileage accumulation dynamometer using a regular grade 87 octane, unleaded, detergent-free fuel. The driving cycle to foul the injectors was 30 minutes city driving, 30 minutes soak, 30 minutes highway driving, 30 minutes soak. The car was continued on the detergent-free fuel for 3600 miles after initially being judged as fouled, and hence the injectors could be considered as severely fouled. The driveability was rated as very poor.

The emissions before the catalytic converter and the pressure differential across each injector were measured and are presented in Table XIV as the measurements at 0 miles after additive addition.

Example VI

This example demonstrates the advantage of using an additive comprising the combination of an amine and amine oxide over amine alone in cleaning up the severely fouled injectors of the vehicle in Comparative Example VI. Approximately 60 ppm of bis (2-hydroxyethyl) cocoamine (HECA) was added to the fuel of Comparative Example VI and the vehicle therein was driven on the same driving cycle described in Example I. After 599 miles of driving, the driveability was judged to have improved slightly, but was still rated as very poor. Measurements of emissions and pressure differential across each injector are presented in Table XIV, and confirm that substantial cleanup had not been achieved for these severely fouled injectors.

The fuel was then replaced with a similar fuel that comprised 56 ppm of HECA and 8 ppm of bis (2-hydroxyethyl) cocoamine oxide. After only 302 miles of additional driving, the driveability went from very poor to fair. Measurements of emissions and pressure differentials, presented in Table XIV, also showed substantial improvements. At the termination of the test, the injectors were removed and flow tested as previously described. These results are presented in Table XV and confirm that the injectors have been cleaned up.

Thus it can be seen that the combination of amine and amine oxide was effective for cleanup of even severely fouled injectors.

TABLE XIV

| Miles After Additive Addition | Additive | Emissions Before Catalytic Converter Idle HC, ppm | Idle CO, % | 2500 RPM HC, ppm | 2500 RPM CO, % | P Leakdown, psi @ Cyl # 1 | 2 | 3 | 4 | Max P Difference |
|---|---|---|---|---|---|---|---|---|---|---|
| 0 | None | 386 | 0.97 | 28 | 1.40 | 17.5 | 17 | 22.5 | 21.5 | 5 |
| 149 | HECA | 698 | 1.47 | 260 | 1.68 | 22 | 20 | 27 | 25 | 7 |
| 299 | HECA | 1038 | 1.47 | 798 | 1.90 | 29 | 24 | 30 | 29 | 6 |
| 451 | HECA | 1047 | 1.47 | 215 | 1.67 | 28 | 23 | 27 | 26 | 5 |
| 599 | HECA | 630 | 1.40 | 227 | 1.63 | 25 | 20 | 24 | 24 | 5 |
| 302 | HECA + Amine Oxide | 196 | 1.09 | 24 | 1.08 | 23 | 20.5 | 22.5 | 22 | 2.5 |

TABLE XV

| Miles Driven After HECA & Amine Oxide Addition | Port Injector Flow Reduction Injector No. | 1 | 2 | 3 | 4 |
|---|---|---|---|---|---|
| 302 | % Flow Reduction | 0 | 5 | 0 | 3 |

What is claimed is:

1. A method for reducing and/or preventing fouling in a multi-port, electronically controlled fuel injection system for an internal combustion engine, said method comprising delivering to said fuel injection system a fuel comprised of an effective amount of an anti-fouling agent comprising (A) an amine having the structural formula:

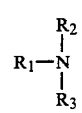

wherein: $R_1$ is $C_6$ to $C_{24}$ alkyl, aryl, cycloaliphatic, heterocyclic, substituted alkyl or substituted aryl; $R_2$ and $R_3$ independently are $C_1$ to $C_{24}$ substituted alkyl, aryl, cycloaliphatic or heterocyclic; and (B) an amine oxide having the structural formula:

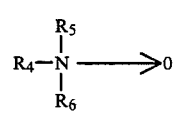

where $R_4$ is $C_6$–$C_{24}$ alkyl, aryl, cycloaliphatic, heterocyclic, substituted alkyl, substituted aryl; $R_5$ and $R_6$ independently are $C_1$–$C_{24}$ alkyl, aryl, substituted alkyl or aryl, cycloaliphatic, heterocyclic and mixtures thereof.

2. The method of claim 1 wherein $R_1$ and $R_4$ are $C_6$ to $C_{20}$ alkyl, or alkylated aryl; and, $R_2$, $R_3$, $R_5$ and $R_6$ independently are hydroxy substituted $C_1$ to $C_{12}$ alkyl.

3. The method of claim 2 wherein $R_1$ and $R_4$ comprise $C_8$ to $C_{18}$ substituents.

4. The method of claim 3 wherein $R_1$ and $R_4$ are derived from fatty acid.

5. The method of claim 4 wherein additive (A) is selected from the group consisting of bis(2-hydroxy ethyl) cocoamine, bis(2-hydroxy ethyl) tallow amine, bis (2-hydroxy ethyl) stearylamine, bis(2-hydroxyethyl) oleyl amine and mixtures thereof, and additive (B) is selected from the group consisting of bis(2-hydroxy ethyl) cocoamine oxide, bis(2-hydroxy ethyl) tallow amine oxide, bis (2-hydroxy ethyl) stearylamine oxide, bis(2-hydroxyethyl) oleyl amine oxide and mixtures thereof.

6. The method of claim 5 wherein said antifouling agent comprises bis(2-hydroxy ethyl) cocoamine and bis(2-hydroxy ethyl) cocoamine oxide.

7. The method of claim 1 wherein said fuel comprises a demulsifying agent selected from the group consisting of:

i. acylated polyglycols;
ii. alkyl aryl sulfonates, polyglycols, oxyalkylated alkylphenol-formaldehyde resins;
iii. oxyalkylated alkylphenol-formaldehyde resins and polyglycols; and,
iv. oxyalkylated alkylphenol-formaldehyde resins;
v. fatty acid alkylamine reaction product; and
vi. mixtures thereof.

8. The methode of claim 7 wherein said anti-fouling agent comprises bis(2-hydroxy ethyl) cocoamine and bis (2-hydroxy ethyl) cocoamine oxide.

9. A fuel composition for an internal combustion engine said fuel composition comprising:

(1) gasoline; and
(2) an effective amount of antifouling agent comprising (A) an amine having the structural formula:

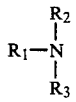

wherein: $R_1$ is $C_6$ to $C_{24}$ alkyl, aryl, cycloaliphatic, heterocyclic, substituted alkyl or substituted aryl; $R_2$ and $R_3$ independently are $C_1$ to $C_{24}$ substituted alkyl, aryl, cycloaliphatic or heterocyclic; and (B) an amine oxide having the structural formula:

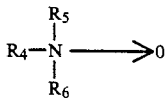

where $R_4$ is $C_6$–$C_{24}$ alkyl, aryl, cycloaliphatic, heterocyclic, substituted alkyl, substituted aryl; $R_5$ and $R_6$ independently are $C_1$–$C_{24}$ alkyl, aryl, substituted alkyl or aryl, cycloaliphatic, heterocyclic and mixtures thereof.

10. The fuel composition of claim 9 wherein $R_1$ and $R_4$ are $C_6$ to $C_{20}$ alkyl, or alkylated aryl; and, $R_2$, $R_3$, $R_5$ and $R_6$ independently are hydroxy substituted $C_1$ to $C_{12}$ alkyl.

11. The fuel composition of claim 10 wherein $R_1$ and $R_4$ comprise $C_8$ to $C_{18}$ substituents.

12. The fuel composition of claim 11 wherein $R_1$ and $R_4$ are derived from fatty acid.

13. The fuel composition of claim 12 wherein additive (A) is selected from the group consisting of bis(2-hydroxy ethyl) cocoamine, bis(2-hydroxy ethyl) tallow amine, bis (2-hydroxy ethyl) stearylamine, bis(2-hydroxyethyl) oleyl amine and mixtures thereof, and additive (B) is selected from the group consisting of bis(2-hydroxy ethyl) cocoamine oxide, bis(2-hydroxy ethyl) tallow amine oxide, bis (2-hydroxy ethyl) stearylamine oxide, bis(2-hydroxyethyl) oleyl amine oxide and mixtures thereof.

14. The fuel composition of claim 13 wherein said anti-fouling agent comprises bis(2-hydroxy ethyl) cocoamine and bis (2-hydroxy ethyl) cocoamine oxide.

15. The fuel composition of claim 9 wherein said fuel comprises a demulsifying agent selected from the group consisting of:

i. acylated polyglycols;
ii. alkyl aryl sulfonates, polyglycols, oxyalkylated alkylphenol-formaldehyde resins;
iii. oxyalkylated alkylphenol-formaldehyde resins and polyglycols;
iv. oxyalkylated alkylphenol-formaldehyde resins;
v. fatty acid alkylamine reaction product;
vi. mixtures thereof.

16. The fuel composition of claim 15 wherein said anti-fouling agent comprises bis(2-hydroxy ethyl) cocoamine and bis(2-hydroxy ethyl) cocoamine oxide and said demulsifynng agent is selected from the group consisting of:

i. acylated polyglycols;
ii. alkyl aryl sulfonates, polyglycols, oxyalkylated alkylphenol-formaldehyde resins;
iii. oxyalkylated alkylphenol-formaldehyde resins and polyglycols;
iv. oxyalkylated alkylphenol-formaldehyde resins;
v. fatty acid alkylamine reaction product;
vi. mixtures thereof.

17. A fuel composition for an internal combustion engine said fuel composition comprising:

A. gasoline;
B. an antifouling agent having the formula

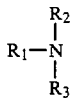

wherein: $R_1$ is $C_6$ to $C_{24}$ alkyl, aryl, cycloaliphatic, heterocyclic, substituted alkyl or substituted aryl; $R_2$ and $R_3$ independently are $C_1$ to $C_{24}$ substituted alkyl, aryl, cycloaliphatic or heterocyclic; and C. a demulsifying agent selectd from the group consisting of:
   i. acylated polyglycols;
   ii. alkyl aryl sulfonates, polyglycols, oxyalkylated alkylphenol-formaldehyde resins;
   iii. oxyalkylated alkylphenol-formaldehyde resins and polyglycols;
   iv. oxyalkylated alkylphenol-formaldehyde resins;
   v. fatty acid alkylamine reaction product; and
   vi. mixtures thereof.

18. The fuel composition of claim 17 wherein $R_1$ is $C_6$ to $C_{20}$ alkyl, or alkylated aryl; and, $R_2$ and $R_3$ independently are hydroxy substituted $C_1$ to $C_{12}$ alkyl.

19. The fuel composition of claim 18 wherein $R_1$ comprises $C_8$ to $C_{18}$ substituents.

20. The fuel composition of claim 19 wherein $R_1$ is derived from fatty acid.

21. The fuel composition of claim 20 wherein the additive is selected from the group consisting of bis(2-hydroxy ethyl) cocoamine, bis(2-hydroxy ethyl) tallow amine, bis (2-hydroxy ethyl) stearylamine, bis(2-hydroxyethyl) oleyl amine and mixtures thereof 22. The fuel composition of claim 21 wherein the anti-fouling agent is bis(2-hydroxy ethyl) cocoamine.

23. The fuel composition of claim 22 wherein the demulsifying agent is selected from the group consisting of:

i. acylated polyglycols;
ii. alkyl phenol-formaldehyde resins and polyglycols; and,
iii. oxyalkylated alkylphenol-formaldehyde resins; and
iv. mixtures thereof.

24. A fuel additive concentrate for gasoline, said additive concentrate comprising:

(1) about 5 to about 60 wt. % of an antifouling agent comprising (A) an amine having the structural formula:

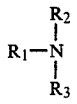

wherein: $R_1$ is $C_6$ to $C_{24}$ alkyl, aryl, cycloaliphatic, heterocyclic, substituted alkyl or substituted aryl; $R_2$ and $R_3$ independently are $C_1$ to $C_{24}$ substituted alkyl, aryl, cycloaliphatic or heterocyclic; and (B) an amine oxide having the structural formula:

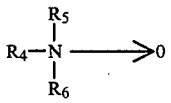

where $R_4$ is $C_6$–$C_{24}$ alkyl, aryl, cycloaliphatic, heterocyclic, substituted alkyl, substituted aryl; $R_5$ and $R_6$ independently are $C_1$–$C_{24}$ alkyl, aryl, substituted alkyl or aryl, cycloaliphatic, heterocyclic and mixtures thereof;

(2) about 0.25 to about 10 wt. % of a demulsifying agent selected from the group consisting of:

i. acylated polyglycols;
ii. alkyl aryl sulfonates, polyglycols, oxyalkylated alkylphenol-formaldehyde resins;
iii. oxyalkylated alkylphenol-formaldehyde resins and polyglycols; and,
iv. oxyalkylated alkylphenol-formaldehyde resins;
v. fatty acid alkylamine reaction product; and
vi. mixtures thereof; and, (3) about 40 to about 95 wt. % solvent comprising an alkyl aromatic hydrocarbon and an alcohol.

25. The fuel additive concentrate of claim 24 wherein $R_1$ and $R_4$ are $C_6$ to $C_{20}$ alkyl, or alkylated aryl; and, $R_2$, $R_3$, $R_5$ and $R_6$ independently are hydroxy substituted $C_1$ to $C_{12}$ alkyl.

26. The fuel additive concentrate of claim 25 wherein the alcohol comprises a $C_4$–$C_{12}$ alcohol.

27. The fuel additive concentrate of claim 25 wherein the alcohol comprises isopropanol and a $C_8$ oxo alcohol.

28. The fuel additive concentrate of claim 25 wherein said alkyl aromatic hydrocarbon comprises xylene.

29. The fuel additive concentrate of claim 25 wherein said amine comprises bis(2-hydroxy ethyl) cocoamine and said amine oxide comprises bis (2-hydroxy ethyl) cocoamine oxide.

30. A method for reducing and/or preventing fouling in a multi-port, electronically controlled fuel injection system for an internal combustion engine, said method comprising delivering to said fuel injection system a fuel comprised of an effective amount of an anti-fouling agent comprising

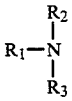

wherein $R_1$ is $C_6$ to $C_{24}$ alkyl, aryl, cycloaliphatic, heterocyclic, substituted alkyl or substituted aryl; $R_2$ and $R_3$ independently are $C_1$ to $C_{24}$ substituted alkyl, aryl, cycloaliphatic or heterocyclic.

31. The method of claim 30 wherein $R_1$ is $C_6$ to $C_{24}$ alkyl, or alkylated aryl; and, $R_2$ and $R_3$ independently are hydroxy substituted $C_1$ to $C_{12}$ alkyl.

32. The method of claim 31 wherein $R_1$ is a $C_8$ to $C_{18}$ substituent.

33. The method of claim 32 wherein $R_1$ is derived from fatty acid.

34. The method of claim 33 wherein the anti-fouling agent is selected from the group consisting of bis(2-hydroxy ethyl) cocoamine, bis(2-hydroxy ethyl) tallow amine, bis (2-hydroxy ethyl) stearylamine, bis(2-hydroxy ethyl) oleyl amine and mixtures thereof.

35. The method of claim 34 wherein said anti-fouling agent comprises bis(2-hydroxy ethyl) cocoamine.

* * * * *